US011222607B2

(12) United States Patent
Sun et al.

(10) Patent No.: US 11,222,607 B2
(45) Date of Patent: Jan. 11, 2022

(54) DISPLAY DRIVING METHOD, DRIVING DEVICE, AND DISPLAY DEVICE COMPRISING DISPLAY PANEL AND BACKLIGHT UNIT

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Binhua Sun, Beijing (CN); Yakun Wang, Beijing (CN); Ziqiang Guo, Beijing (CN); Jian Sun, Beijing (CN); Wenyu Li, Beijing (CN); Feng Zi, Beijing (CN); Bingxin Liu, Beijing (CN); Yadong Ding, Beijing (CN); Jiyang Shao, Beijing (CN); Lin Lin, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/650,620

(22) PCT Filed: Mar. 29, 2019

(86) PCT No.: PCT/CN2019/080598
§ 371 (c)(1),
(2) Date: Mar. 25, 2020

(87) PCT Pub. No.: WO2020/199007
PCT Pub. Date: Oct. 8, 2020

(65) Prior Publication Data
US 2021/0233478 A1 Jul. 29, 2021

(51) Int. Cl.
*G09G 3/34* (2006.01)
*G09G 3/36* (2006.01)

(52) U.S. Cl.
CPC ..... *G09G 3/3426* (2013.01); *G09G 3/36* (2013.01); *G09G 2310/061* (2013.01);
(Continued)

(58) Field of Classification Search
None
See application file for complete search history.

(56) References Cited

U.S. PATENT DOCUMENTS

2006/0146005 A1* 7/2006 Baba ..... G09G 3/3233 345/102
2007/0146299 A1 6/2007 Kim et al.
(Continued)

FOREIGN PATENT DOCUMENTS

CN 1991457 A 7/2007
CN 102568411 7/2012
(Continued)

OTHER PUBLICATIONS

Office Action and English translation for corresponding Chinese Application No. 201980000442.7 dated Aug. 2, 2021. 26 pages.

*Primary Examiner* — Chad M Dicke
(74) *Attorney, Agent, or Firm* — Leason Ellis LLP

(57) ABSTRACT

A display driving method of a display device, a driving device and the display device are provided. The display device includes a display panel and a backlight unit. The display driving method includes: sending image information of a display image to the display panel; acquiring a scanning parameter of the display image from the image information; acquiring a driving parameter of a plurality of rows of backlight blocks based on the scanning parameter of the
(Continued)

display image, and driving the plurality of rows of backlight blocks based on the driving parameter.

16 Claims, 6 Drawing Sheets

(52) U.S. Cl.
CPC ... *G09G 2320/02* (2013.01); *G09G 2320/064* (2013.01); *G09G 2320/0646* (2013.01)

(56) References Cited

U.S. PATENT DOCUMENTS

| | | | | |
|---|---|---|---|---|
| 2008/0074381 | A1* | 3/2008 | Kumamoto ..... | G09G 3/342 345/102 |
| 2011/0096101 | A1 | 4/2011 | Lee et al. | |
| 2011/0267377 | A1 | 11/2011 | Kim et al. | |
| 2012/0147291 | A1 | 6/2012 | Seo | |
| 2012/0262940 | A1* | 10/2012 | Miyairi ..... | G02F 1/133621 362/602 |
| 2016/0117999 | A1 | 4/2016 | Hayashi et al. | |
| 2019/0180698 | A1 | 6/2019 | Gu et al. | |
| 2020/0035170 | A1 | 1/2020 | Shi et al. | |
| 2020/0117050 | A1 | 4/2020 | Shao et al. | |

FOREIGN PATENT DOCUMENTS

| | | | |
|---|---|---|---|
| CN | 103413539 | A | 11/2013 |
| CN | 106384576 | | 2/2017 |
| CN | 107331355 | | 11/2017 |
| CN | 107978280 | A | 5/2018 |
| CN | 108227287 | A | 6/2018 |
| CN | 108694914 | | 10/2018 |
| CN | 109192146 | | 1/2019 |
| CN | 109192150 | A | 1/2019 |
| EP | 3493194 | | 6/2019 |
| JP | 2015049487 | | 3/2015 |
| KR | 20110120017 | A | 11/2011 |

* cited by examiner

DISPLAY DRIVING METHOD, DRIVING DEVICE, AND DISPLAY DEVICE COMPRISING DISPLAY PANEL AND BACKLIGHT UNIT

CROSS-REFERENCE TO RELATED PATENT APPLICATIONS

This application is a U.S. National Stage Application under 35 U.S.C. § 371 of International Patent Application No. PCT/CN2019/080598, filed Mar. 29, 2019, which is incorporated by reference in its entirety.

TECHNICAL FIELD

Embodiments of the present disclosure relate to a display driving method of a display device, a driving device of the display device, and the display device.

BACKGROUND

With continuous improvement of electronic technology level, Virtual Reality (VR) technology or Augmented Reality (AR) technology is as a high and new technology, and has been increasingly applied in daily life, such as in games, entertainment, and the like. Virtual Reality technology is also referred to as vision technology or artificial environment.

An existing virtual reality system simulates a virtual three-dimensional (3D) world mainly through a high-performance computing system including a central processing unit (CPU), and provides a user with a sensory experience of vision, hearing, etc. through a head-mounted device, so that the user can feel as if he is present on the scene, and in addition, human-computer interaction can be carried out.

SUMMARY

At least one embodiment of the present disclosure provides a display driving method of a display device, the display device includes a display panel and a backlight unit, the display panel includes a plurality of rows of display blocks, the backlight unit includes a plurality of rows of backlight blocks, and the plurality of rows of backlight blocks are configured to provide light for display to the plurality of rows of display blocks of the display panel respectively and correspondingly, and the display driving method includes: sending image information of a display image to the display panel; acquiring a scanning parameter of the display image from the image information; and acquiring a driving parameter of the plurality of rows of backlight blocks based on the scanning parameter of the display image, and driving the plurality of rows of backlight blocks based on the driving parameter.

For example, in the display driving method provided by some embodiments of the present disclosure, each display block includes a plurality of rows of sub-pixels, a display operation of the plurality of rows of sub-pixels includes a response stage and a display stage after the response stage, and the driving the plurality of rows of backlight blocks based on the driving parameter includes: enabling the plurality of rows of backlight blocks to respectively emit light in a case where the sub-pixels of the display blocks corresponding to the plurality of rows of backlight blocks are in the display stage, and enabling the plurality of rows of backlight blocks not to emit light in a case where the sub-pixels of the display blocks corresponding to the plurality of rows of backlight blocks are in the response stage.

For example, in the display driving method provided by some embodiments of the present disclosure, acquiring the scanning parameter of the display image from the image information, includes: generating a periodic pulse waveform that is synchronized with a scanning time period and a blanking time period of the display image based on the image information of the display image; and sending the periodic pulse waveform to control the backlight unit.

For example, in the display driving method provided by some embodiments of the present disclosure, acquiring the driving parameter of the plurality of rows of backlight blocks based on the scanning parameter of the display image, and the driving the plurality of rows of backlight blocks based on the driving parameter, includes: detecting and acquiring the periodic pulse waveform; determining a logic value of a stability flag bit of the periodic pulse waveform; if the stability flag bit of the periodic pulse waveform is a first logic value, determining whether the periodic pulse waveform is in a stable state; if the stability flag bit of the periodic waveform is a second logic value, driving the plurality of rows of backlight blocks based on the driving parameter, so that the plurality of rows of backlight blocks respectively emit light in a case where the sub-pixels of the display blocks corresponding to the plurality of rows of backlight blocks are in the display stage, and do not emit light in a case where the sub-pixels of the display blocks corresponding to the plurality of rows of backlight blocks are in the response stage.

For example, in the display driving method provided by some embodiments of the present disclosure, if the stability flag bit of the periodic pulse waveform is the first logic value, determining whether the periodic pulse waveform is in the stable state, includes: in a case where the periodic pulse waveform is in the stable state, assigning the stability flag bit to the second logic value, and acquiring the driving parameter of the plurality of rows of backlight blocks based on the periodic pulse waveform; and in a case where the periodic pulse waveform is not in the stable state, continuing to detect and acquire the periodic pulse waveform.

For example, in the display driving method provided by some embodiments of the present disclosure, if the stability flag bit of the periodic pulse waveform is the second logic value, driving the plurality of rows of backlight blocks based on the driving parameter, includes: after, by taking a rising edge of the periodic pulse waveform as a reference, delaying a time period corresponding to the response stage of one row of sub-pixels and a scanning time period of the sub-pixels of the display blocks corresponding to one row of backlight blocks, driving the plurality of rows of backlight blocks row by row based on the driving parameter.

For example, in the display driving method provided by some embodiments of the present disclosure, after driving a first row of backlight blocks, the plurality of rows of backlight blocks, other than the first row of backlight blocks, are driven row by row with an interval which is equal to the scanning time period of the sub-pixels of the display blocks corresponding to the one row of backlight blocks.

For example, in the display driving method provided by some embodiments of the present disclosure, the stable state is a state that the periodic pulse waveform is continuously detected.

For example, in the display driving method provided by some embodiments of the present disclosure, the driving parameter includes a refresh frequency and a driving current of a synchronization signal.

For example, in the display driving method provided by some embodiments of the present disclosure, the refresh frequency of the synchronization signal is a reciprocal of a scanning time period of the sub-pixels of the display blocks corresponding to one row of backlight blocks.

For example, in the display driving method provided by some embodiments of the present disclosure, the driving current is expressed as:

$$In=Ia/f(Tn),$$

where In represents the driving current, Tn represents the scanning time period of the sub-pixels of the display blocks corresponding to the one row of backlight blocks, f(Tn) represents a weighting function of Tn, and Ia represents an average current that drives the backlight unit in a case where the display panel reaches a predetermined brightness.

For example, in the display driving method provided by some embodiments of the present disclosure, the backlight unit is driven by a local dimming manner.

For example, in the display driving method provided by some embodiments of the present disclosure, in a case where a vertical synchronization signal of a next row of backlight blocks arrives, light-emitting elements in a previous row of the backlight blocks are in a non-light-emitting state.

At least one embodiment of the present disclosure further provides a driving device of a display device, the display device includes a display panel and a backlight unit, the display panel includes a plurality of rows of display blocks, the backlight unit includes a plurality of rows of backlight blocks, the plurality of rows of backlight blocks are configured to provide light for display to the plurality of rows of display blocks of the display panel respectively and correspondingly, and the driving device includes a display control unit and a backlight control unit; the display control unit is configured to send image information of a display image to the display panel, and acquire a scanning parameter of the display image from the image information and send the scanning parameter to the backlight control unit; and the backlight control unit is configured to acquire the driving parameter of the plurality of rows of backlight blocks of the backlight unit based on the scanning parameter of the display image, and drive the plurality of rows of backlight blocks based on the driving parameter.

For example, the driving device provided by some embodiments of the present disclosure further includes an image processing unit, and the image processing unit is configured to send the image information of the display image and backlight data of the backlight unit to the display control unit and the backlight control unit, respectively.

For example, in the driving device provided by some embodiments of the present disclosure, each display block includes a plurality of rows of sub-pixels, a display operation of the plurality of rows of sub-pixels includes a response stage and a display stage after the response stage, and the backlight control unit is further configured to control the plurality of rows of backlight blocks to respectively emit light in a case where the sub-pixels of the display blocks corresponding to the plurality of rows of backlight blocks are in the display stage, and to control the plurality of rows of backlight blocks not to emit light in a case where the sub-pixels of the display blocks corresponding to the plurality of rows of backlight blocks are in the response stage.

For example, in the driving device provided by some embodiments of the present disclosure, the display control unit is further configured to generate a periodic pulse waveform that is synchronized with a scanning time period and a blanking time period of the display image based on the image information of the display image, and to send the periodic pulse waveform to control the backlight unit.

For example, in the driving device provided by some embodiments of the present disclosure, the backlight control unit is further configured to: detect and acquire the periodic pulse waveform; determine a logic value of a stability flag bit of the periodic pulse waveform; if the stability flag bit of the periodic pulse waveform is a first logic value, determine whether the periodic pulse waveform is in a stable state; and if the stability flag bit of the periodic waveform is a second logic value, drive the plurality of rows of backlight blocks based on the driving parameter, so that the plurality of rows of backlight blocks respectively emit light in the case where the sub-pixels of the display blocks corresponding to the plurality of rows of backlight blocks are in the display stage, and do not emit light in the case where the sub-pixels of the display blocks corresponding to the plurality of rows of backlight blocks are in the response stage.

For example, in the driving device provided by some embodiments of the present disclosure, the backlight control unit is further configured to: in a case where the periodic pulse waveform is in the stable state, assign the stability flag bit to the second logic value, and acquire the driving parameter of the plurality of rows of backlight blocks based on the periodic pulse waveform; in a case where the periodic pulse waveform is not in the stable state, continue to detect and to acquire the periodic pulse waveform.

For example, in the driving device provided by some embodiments of the present disclosure, the backlight control unit is further configured to after, by taking a rising edge of the periodic pulse waveform as a reference, delaying a time period corresponding to the response stage of one row of sub-pixels and a scanning time period of the sub-pixels of the display blocks corresponding to one row of backlight blocks, drive the plurality of rows of backlight blocks row by row based on the driving parameter.

For example, in the driving device provided by some embodiments of the present disclosure, the backlight control unit is further configured to after driving a first row of backlight blocks, drive the plurality of rows of backlight blocks, other than the first row of backlight blocks, row by row with an interval which is equal to the scanning time period of the sub-pixels of the display blocks corresponding to the one row of backlight blocks.

For example, in the driving device provided by some embodiments of the present disclosure, the backlight control unit is further configured to enable light-emitting elements in a previous row of the backlight blocks to be in a non-light-emitting state in a case where a vertical synchronization signal of a next row of backlight blocks arrives.

At least one embodiment of the present disclosure further provides a display device, which includes the driving device provided by any one of the embodiments.

For example, the display device provided by some embodiments of the present disclosure further includes the display panel and the backlight unit.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1A:
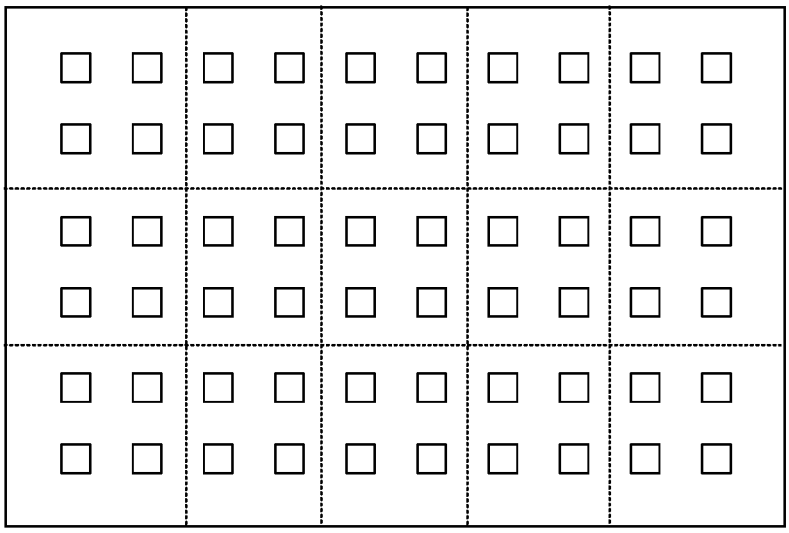
FIG. 1A is a schematic diagram of a backlight unit.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the absolute position of the object which is described is changed, the relative position relationship may be changed accordingly.

The present disclosure is described below with reference to some specific embodiments. In order to enable the following description of the embodiments of the present disclosure clear and concise, the present disclosure omits detailed description of known functions and known components. In the case where any component in the embodiments of the present disclosure appears in more than one drawing, the component is denoted by the same or similar reference numerals in the drawings.

A liquid crystal display panel includes a liquid crystal panel and a backlight unit. Generally, the liquid crystal panel includes an array substrate and an opposite substrate (for example, a color filter substrate) which are opposite to each other to form a liquid crystal cell, and a liquid crystal layer is filled between the array substrate and the opposite substrate in the liquid crystal cell. A first polarizer is on the array substrate, a second polarizer is on the opposite substrate, and a polarization direction of the first polarizer is perpendicular to a polarization direction of the second polarizer. The backlight unit is on a non-display side of the liquid crystal panel and is used for providing a planar light source for the display of the liquid crystal panel. Liquid crystal molecules of the liquid crystal layer are twisted under an action of a driving electric field formed between a pixel electrode of a sub-pixel of the array substrate and a common electrode of the array substrate or a common electrode of the opposite substrate, a polarization direction of light passing through the liquid crystal layer can be controlled after the liquid crystal molecules are twisted by a preset angle, and transmittance of the light is controlled by the cooperation of the first polarizer and the second polarizer, thereby achieving grayscale display.

For example, the backlight unit may be a direct-lit backlight unit or a side-lit backlight unit. The direct-lit backlight unit or the direct-lit backlight unit may include a plurality of point light sources (for example, light-emitting diodes (LEDs)) arranged side by side and a diffusion plate. Light emitted by the point light sources is homogenized by the diffusion plate, and then is incident on the liquid crystal panel for display. For example, the side-lit backlight unit may use a global dimming technology to achieve the overall brightness adjustment of the backlight unit, and the direct-lit backlight unit may use a progressive lighting method to achieve the brightness adjustment of the backlight unit.

At present, for example, high-resolution liquid crystal display panels are also gradually applied to VR devices. During use of the VR device, because the human eyes are relatively close to a display screen, the human eyes are easier to perceive a display effect of a display image, and therefore, the requirements for a resolution and a display quality of the display panel are also getting higher and higher.

The local dimming (LD) technology can not only reduce power consumption of the display panel, but also achieve dynamic dimming of a backlight region, thus greatly improving the contrast ratio of a display image and improving the display quality of the display panel. Therefore, for the high-resolution liquid crystal display panel, the direct-lit backlight unit can be controlled by using the local dimming technology, thereby improving the display image quality of the display panel and meeting the requirements that the display panel of the VR device has on the display image quality.

For example, the local dimming technology can divide an entire backlight unit into a plurality of backlight blocks which can be driven individually, and each of the plurality of backlight blocks includes one or more LEDs. According to gray scales to be displayed of different parts of a display picture, driving currents of the LEDs in the backlight blocks corresponding to these parts are automatically adjusted, so that brightness of each block in the backlight unit is individually adjusted, thereby improving the contrast ratio of the display picture. The local dimming technology is generally only applicable to the direct-lit backlight unit, and a plurality of LEDs as the light sources are evenly distributed throughout an entire backplane, for example.

For example, in an exemplary direct-lit backlight unit, a schematic diagram of dividing regions of the LED light sources in the entire backplane is shown in FIG. 1A. A small square as shown in FIG. 1A represents an LED unit, and a plurality of regions separated by broken lines represent a plurality of backlight blocks. Each of the plurality of backlight blocks includes one or more LED units and can be controlled independently of other backlight blocks. For example, the LEDs in each of the plurality of backlight blocks are linked, that is, currents passing through the LEDs located in the same backlight block are consistent, so that the LEDs located in the same backlight block has the substantially same luminance brightness.

Figure 1B:
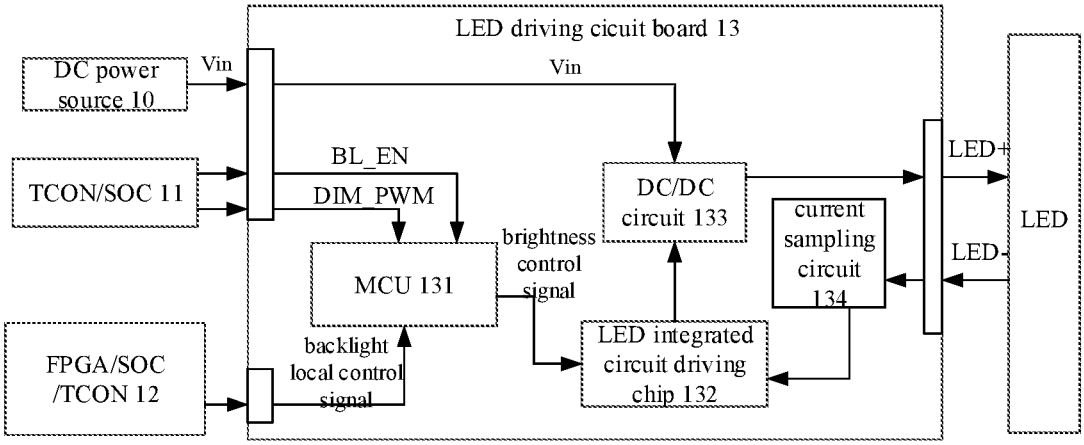
FIG. 1B is a schematic diagram of an exemplary system for performing local dimming on the backlight unit as shown in FIG. 1A.

FIG. 1B is a schematic diagram of an exemplary system for performing local dimming process on the backlight unit as shown in FIG. 1A. For example, in some examples, the system is implemented by a hardware circuitry. As shown in FIG. 1B, the system includes, for example, a DC (direct-current) power source 10, a TCON (Timer Control Register)/SOC (System On Chip) 11, an FPGA (Field-Programmable Gate Array)/SOC/TCON 12, and an LED driving circuit board 13 for driving the LEDs to emit light. As shown in FIG. 1B, the LED driving circuit board 13 includes a micro-chip unit (MCU) 131, an LED integrated circuit driving chip 132, a DC/DC circuit 133, and a current sampling circuit 134. The LED driving circuit board 13 is configured to process each frame of image signal to obtain processed backlight brightness data of respective backlight blocks, and generate driving currents used for various backlight blocks based on the backlight brightness data. The driving currents are output to the corresponding backlight blocks to drive the LEDs in the corresponding backlight blocks to emit light by currents.

The MCU 131 receives a backlight local control signal (Local Dimming SPI (Serial Peripheral Interface) signal) from the FPGA/SOC/TCON 12, and the backlight local control signal is used in an "AND" operation (controlling whether the "AND" operation is performed according to an enable signal (BL_EN)) with a brightness modulation signal (DIM_PWM) from the TCON 11 to obtain brightness control signals of the respective backlight blocks. Then, the MCU 131 outputs the brightness control signals to the LED integrated circuit driving chip 132 to implement current control of the LEDs of the respective backlight blocks, thereby controlling the light-emitting brightness of the respective backlight blocks. For example, the TCON 12 and the TCON 11 may be the same TCON. For example, both the backlight local control signal and the brightness modulation signal may be implemented by the TCON 11, the embodiments of the present disclosure are not limited to this case.

For example, the system for performing the local dimming process is powered by an external DC power source 10, and the supply voltage Vin of the power source 10 is typically 24 voltages (V). For example, the DC/DC circuit 133 can employ a voltage conversion circuit (e.g., a Boost circuit) to boost the supply voltage Vin to a driving voltage required by lighting the LEDs of the respective backlight blocks.

Because even a small fluctuation of a working voltage applied to the LEDs may cause a large change of the current flowing though the LEDs, the LEDs in the system can be dimmed by using a constant-current control mode. To achieve the constant-current control, cathode electrodes (LED−) of the plurality of LEDs connected in series in each of the plurality of backlight blocks are connected to the current sampling circuit 134 to monitor, in real time, the stability of the currents flowing though LEDs that are driven. The current sampling circuit 134 converts the currents flowing through the LEDs into voltage signals and feeds the voltage signals back to the LED integrated circuit driving chip 132, and then the LED integrated circuit driving chip 132 feeds the voltage signals back to the DC/DC circuit 133. After receiving the voltage signals, the DC/DC circuit 133 adjusts output voltages input to anode electrodes (LED+) of the LEDs to achieve a steady current effect on the LEDs. For example, the converted voltage signals are sampled and the sampled voltage signals are compared with a preset reference voltage. In the case where the sampled voltage signals are higher than the reference voltage, the current sampling circuit 134 outputs a control signal, to enable the DC/DC circuit 133 to reduce the output voltage, thereby reducing the currents flowing through the LEDs; otherwise, the current sampling circuit 134 outputs another control signal, to enable the DC/DC circuit 133 to boost the output voltage to increase the currents flowing through the LEDs. That is, the current sampling circuit 134 can be used as a negative feedback circuit to achieve the constant-current control of the LEDs to enable the LEDs to work stably.

Each of the exemplary backlight units illustrated in FIGS. 1A and 1B includes a plurality of rectangular backlight regions arranged in an array; the local dimming technology can adjust the brightness and darkness of the corresponding backlight blocks according to gray scales of a picture content displayed by the liquid crystal display panel; for a part with higher brightness (gray scale) of the picture, the brightness of the corresponding backlight blocks is also high; and for a part with a lower brightness of the picture, the brightness of the corresponding backlight blocks is also low, thereby achieving an effect of reducing backlight power consumption, improving the contrast ratio of the display screen, and enhancing the image quality.

However, a response time period of the liquid crystal molecules in the liquid crystal display panel (that is, a duration from the time when the liquid crystal molecules start to twist to the time when the liquid crystal molecules finish twisting and stabilize to be at a preset angle) is long, for example, the response time period of the liquid crystal molecules is usually from 20 ms to 30 ms, the response time period of liquid crystal molecules with fast response function used in VR device also needs 4 ms to 5 ms, so it is easy to appear dynamic blurring phenomenon in the display process of the display panel. For example, in the display device using the side-lit backlight unit, a black insertion technology is usually used to avoid smear and dynamic blurring which are caused by twist of the liquid crystal molecules. However, unlike the lighting method of the side-lit backlight unit, the direct-lit backlight unit usually uses a driving method of lighting the backlight blocks row by row, which makes it difficult to apply the black insertion technology to the direct-lit backlight unit, so how to solve the phenomena, such as the dynamic blurring that occurs in the display process of the display device using the direct-lit backlight unit, have not yet been achieved by mature technical means.

At present, the above phenomenon is usually solved by manually detecting and setting the scanning time period of the direct-lit backlight unit to be delayed. For example, the specific operation includes: measuring a display time period of the display panel through an oscilloscope; calculating the time period to be delayed for lighting a first row of backlight blocks of the direct-lit backlight unit according to the display time period; and manually writing the time period to be delayed into a computer-readable instruction that controls the direct-lit backlight unit to emit light, so as to avoid the dynamic blurring phenomenon that occurs during the display process of the display panel. However, the method of manually detecting and setting the scanning time period of the direct-lit backlight unit to be delayed not only needs to repeatedly detect multi-dimensional signals, which increases detection errors, but also reduces development efficiency, increases labor costs, and is unfavorable for market promotion of products.

At least one embodiment of the present disclosure provides a display driving method of a display device. The display device includes a display panel and a backlight unit. The display panel includes a plurality of rows of display blocks, each display block includes a plurality of rows of sub-pixels, and a display operation of the sub-pixel includes a response stage and a display stage after the response stage. The backlight unit includes a plurality of rows of backlight blocks, and the plurality of rows of backlight blocks are configured to respectively provide light for display for the plurality of rows of display blocks of the display panel. The display driving method includes: sending image information of a display image to the display panel; acquiring a scanning parameter of the display image from the image information, acquiring a driving parameter of the plurality of rows of backlight blocks according to the scanning parameter of the display image, and driving the plurality of rows of backlight blocks according to the driving parameter, so that the plurality of rows of backlight blocks respectively emit light in the case where the sub-pixels of the display blocks corresponding to the plurality of rows of backlight blocks are in the display stage and that the plurality of rows of backlight blocks respectively do not emit light in the case where the sub-pixels of the display blocks corresponding to the plurality of rows of backlight blocks are in the response stage.

At least one embodiment of the present disclosure further provides a driving device and a display device corresponding to the display driving method described above.

The display driving method provided by the above embodiments of the present disclosure can avoid the dynamic blurring phenomenon that occurs during the display process of the display panel, optimize a display effect of the display panel, ensure a display brightness of the display panel, and improve an user experience; meanwhile, in some embodiments of the present disclosure, in the case where a refresh frequency and a liquid crystal scanning time period of the liquid crystal display panel are changed, the scanning time period and the driving parameter of the backlight unit can be automatically set, thereby reducing labor costs and improving a development efficiency of the display device.

Embodiments of the present disclosure and examples thereof will be described in detail below with reference to the accompanying drawings.

Figure 2:
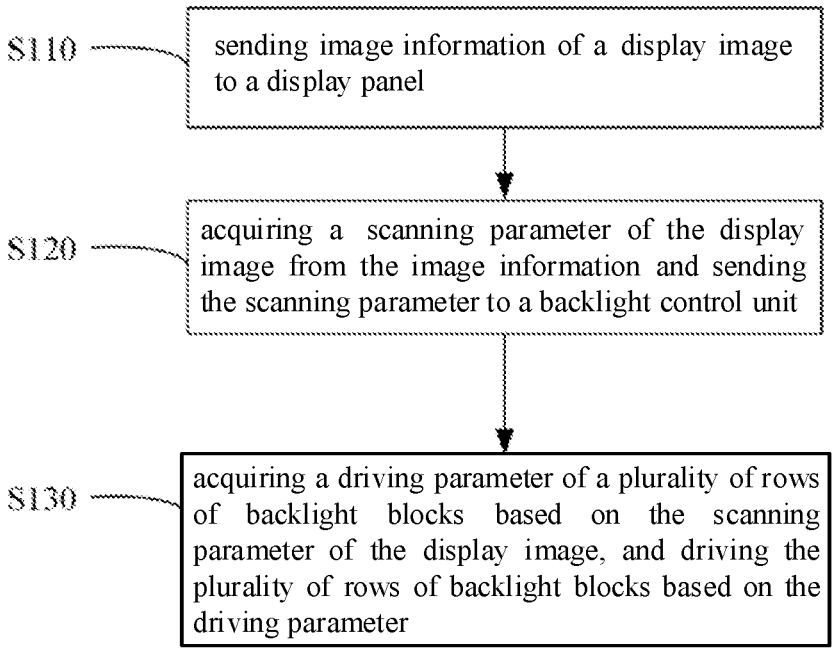
FIG. 2 is a flowchart of a display driving method according to some embodiments of the present disclosure.

FIG. 2 is a flowchart of a display driving method of a display device provided by some embodiments of the present disclosure. For example, the display device includes a display panel and a backlight unit, and the backlight unit is on a non-display side of the display panel, includes a plurality of backlight blocks, and is driven by a local dimming mode. For example, the display panel includes a plurality of rows of display blocks, each display block includes a plurality of rows of sub-pixels, and a display operation of these sub-pixels includes a response stage and a display stage after the response stage. The backlight unit includes a plurality of rows of backlight blocks. For example, the plurality of rows of backlight blocks are in one-to-one correspondence with the plurality of rows of display blocks, and the plurality of rows of backlight blocks are configured to respectively provide light for display for the plurality of rows of display blocks of the display panel. For example, after responding to a vertical synchronization signal, which indicates a start of a frame of picture, of the display panel, the response stage is a stage in which the liquid crystal molecules in a sub-pixel start to twist in response to a driving electric field applied by a pixel electrode and a common electrode which are in the sub-pixel, and the display stage is a stage in which normal display is performed after the liquid crystal molecules in the sub-pixel are twisted.

For example, the plurality of rows of backlight blocks of the backlight unit may be set in an array arrangement as shown in FIG. 1A, the embodiments of the present disclosure are not limited to this case. For example, each backlight block of the backlight unit includes one or more LEDs, and for example, one or more LEDs are mini-LEDs (for example, a size of a mini-LED ranges from 10 μm to 100 μm) can be used. For example, the display device may be a liquid crystal display (LCD), an electronic paper display device, or the like; for example, the display device may be a virtual reality device, such as a virtual display helmet or the like. For example, the virtual reality device may be in a form of an all-in-one machine or a separate machine, the embodiments of the present disclosure are not limited to this case. Correspondingly, the display panel of the display device may be a liquid crystal display panel, an electronic paper display panel, or the like; for example, the liquid crystal panel may be of a vertical electric field type or a horizontal electric field type; and the embodiments of the present disclosure are not limited to the specific structure and type (for example, the vertical electric field type of liquid crystal display panel or the horizontal electric field type of liquid crystal display panel) of the display panel.

For example, the LCD display device may further include a pixel array, a data decoding circuit, a timing controller, a gate driver, a data driver, a storage device (for example, a flash memory or the like), and the like. The pixel array includes a plurality of sub-pixels arranged in an array, and the sub-pixels are arranged in a plurality of rows and a plurality of columns. A number of the rows and a number of the columns are related to the resolution of the display device. Each sub-pixel includes a pixel electrode; and each sub-pixel may further include a common electrode, or multiple sub-pixels share the same common electrode. The data decoding circuit receives a display input signal and decodes the display input signal to obtain a display data signal; and the timing controller outputs timing signals to control the gate driver, the data driver, etc., to work synchronously, and can perform gamma correction on the display data signal. The processed display data signal is input to the data driver to perform a display operation. These components can be implemented in a manner in the art, the embodiments of the present disclosure are not limited thereto, and these components are not described herein again.

The display driving method of some embodiments of the present disclosure can be implemented at least in part by software, hardware, firmware, or any combination thereof, can solve the phenomena, such as smear or dynamic blurring caused by the response characteristics of the liquid crystal during the display process of the display panel, and can also avoid the change of the driving parameter of the backlight unit, caused by the adjustment of the refresh frequency and the liquid crystal scanning time period of the liquid crystal display, by the manual detection and setting, so as to reduce labor costs and improve the development efficiency of the display device.

Hereinafter, the display driving method of the display device provided by some embodiments of the present disclosure will be described with reference to FIG. 2. As shown in FIG. 2, the display driving method includes steps S110 to S130, and the steps S110 to S130 of the display driving method and respective exemplary implementations of the steps S110 to S130 are respectively described below.

Step S110: sending image information of a display image to the display panel.

Step S120: acquiring a scanning parameter of the display image from the image information and sending the scanning parameter to the backlight control unit.

Step S130: acquiring a driving parameter of the plurality of rows of backlight blocks based on the scanning parameter of the display image, and driving the plurality of rows of backlight blocks based on the driving parameter.

For example, the plurality of rows of backlight blocks are driven based on the driving parameter, so that the plurality of rows of backlight blocks emit light in the case where the sub-pixels of the display blocks corresponding to the plurality of rows of backlight blocks are in the display stage, and that the plurality of rows of backlight blocks do not emit light in the case where the sub-pixels of the display blocks corresponding to the plurality of rows of backlight blocks are in the response stage.

For example, in some embodiments of the present disclosure, "the sub-pixels of the display blocks corresponding to the plurality of rows of backlight block" can be understood as that the backlight blocks and the sub-pixels of the display panel overlap in an orthographic projection direction. That is, "correspondence" in some embodiments of the present disclosure can be understood as overlapping in the orthographic projection direction.

For example, in some embodiments of the present disclosure, the display device may further include an image processing unit (Graphics Processing Unit, GPU), and the like. For example, the image processing unit may perform image rendering in real time to acquire the image information of the display image, and may also acquire the backlight data that can implement local dimming for each backlight block in the backlight unit according to an algorithm in the art. It should be noted that the image information of the display image or the backlight data of the backlight unit can also be acquired through a central processing unit (CPU), a field programmable logic gate array (FPGA), or other forms of processing units with data processing capability and/or instruction execution capability, and corresponding computer instructions. The embodiments of the present disclosure are not limited thereto.

For step S110, for example, the image information of the display image is sent to the display panel, so that the display panel is driven to display accordingly. For example, the image information may include information, such as display data, the scanning time period, the blanking time period, and the refresh frequency of the display panel, related to the display image, and the embodiments of the present disclosure are not limited in this aspect.

For example, a display control unit may be provided to send the image information of the display image to the display panel. For example, the display control unit may acquire the image information after performing the image rendering in the image processing unit through a physical interface, such as HDMI (High Definition Multimedia Interface) and the like, convert the image information into, for example, MIPI (Mobile Industry Processor Interface) signal by a bridge chip, and send the MIPI signal to the display panel under the control of the vertical synchronization signal Vsync for controlling the display of the display panel. For example, the bridge chip may adopt a conversion chip having a signal conversion function, and the embodiments of the present disclosure are not limited in this aspect.

Figure 4:
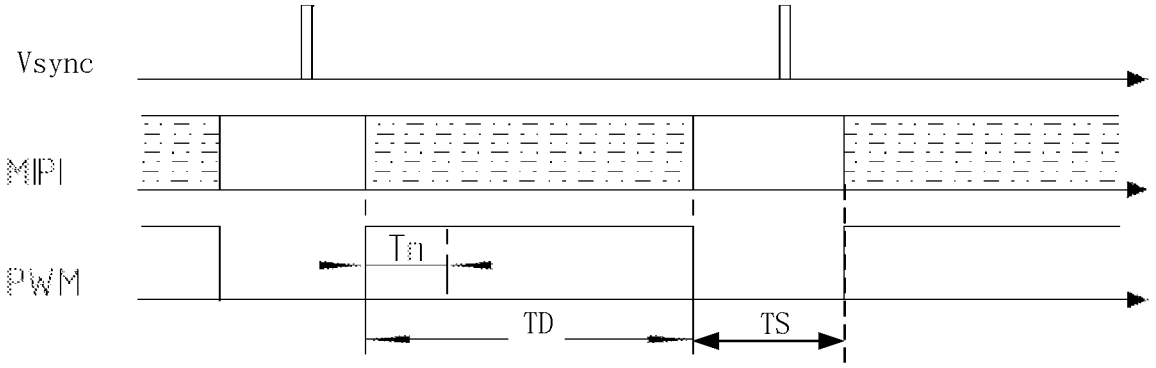
FIG. 4 is a schematic diagram of generating a periodic pulse waveform according to some embodiments of the present disclosure.

For example, as shown in FIG. 4, TD represents the scanning time period of the display panel in the MIPI signal (i.e., the scanning time period from the first row of sub-pixels to a last row of sub-pixels), TS represents a blanking time period of the display panel in the MIPI signal, and Tn represents the scanning time period of one row of display blocks in the display panel corresponding to one row of backlight blocks. For example, the relationship between TD and Tn will be described in detail below, and description is omitted here. For example, after the display panel receives the MIPI signal, the display data included in the MIPI signal is output to the display panel row by row for display in the scanning stage corresponding to the scanning time period TD.

For example, the display control unit may be further configured to provide various control signals, such as a gate scanning signal, the vertical synchronization signal, and the like, required for controlling the display of the display panel, which are not described herein again.

For step S120, for example, the scanning parameter of the display image is acquired from the image information of the display image and sent to the backlight control unit. For example, the scanning parameter may be a scanning frequency, the scanning time period TD or the blanking time period TS corresponding to the display of a frame of image, and the like. The scanning parameter is sent to the backlight control unit, and the backlight control unit controls the backlight unit to emit light based on the scanning parameter.

Figure 3:
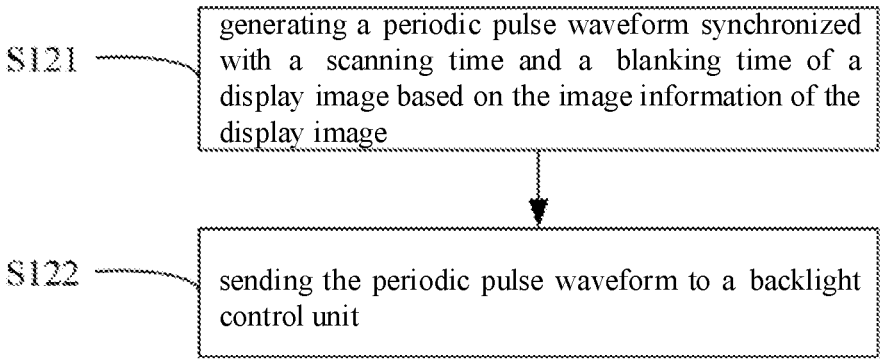
FIG. 3 is a flowchart of an example of acquiring a scanning parameter of a display image according to some embodiments of the present disclosure.

FIG. 3 is a flowchart of an example of acquiring the scanning parameter of the display image provided by some embodiments of the present disclosure. That is, FIG. 3 is a flowchart of an example of step S120 as shown in FIG. 2. For example, in the example as shown in FIG. 3, the method of acquiring the scanning parameter includes steps S121 to S122. Hereinafter, the display driving method according to an embodiment of the present disclosure will be described with reference to FIG. 3.

Step S121: generating a periodic pulse waveform synchronized with the scanning time period and the blanking time period of the display image based on the image information of the display image.

For example, as shown in FIG. 4, the display control unit generates the periodic pulse waveform PWM (Pulse Width Modulation) synchronized with the scanning time period TD and the blanking time period TS of the MIPI signal according to the MIPI signal, and thereby the scanning parameter of the display image is loaded into the periodic pulse waveform, so that as long as only the periodic pulse waveform PWM needs to be transmitted, the image information (for example, the scanning parameter) related to the display image can be transmitted together. For example, as shown in FIG. 4, a pulse portion of the periodic pulse waveform represents the scanning time period TD of one frame of display image, and a non-pulse portion (i.e., the portion between the pulses) represents the blanking time period TS of one frame of display image.

Step S122: sending the periodic pulse waveform to the backlight control unit.

For example, as long as the periodic pulse waveform is sent to the backlight control unit (for example, MCU 131 as shown in FIG. 1B), the backlight control unit can extract the scanning parameter (for example, the scanning parameter may include the scanning time period TD and the blanking time period TS) of the display image from the periodic pulse waveform, so that the driving parameter of the backlight unit may be acquired in a subsequent step based on the scanning parameter carried by the periodic pulse waveform to control the backlight unit to emit light.

It should be noted that the scanning parameter may also be sent to the backlight control unit directly or in other forms, the embodiments of the present disclosure are not limited in this aspect.

For example, by means of the display control unit, the scanning parameter of the display image may be acquired from the image information and be sent to the backlight control unit.

For step S130, for example, the driving parameter of the plurality of rows of backlight blocks in the backlight unit may be respectively calculated according to the periodic pulse waveform output by the display control unit. For example, the driving parameter may include a refresh frequency, a driving current and the like of a synchronization signal required by the LED driving unit, and may also include a value of a voltage provided by a switch channel, a turn-on time period of the switch channel, and a turn-on time period of an output channel for outputting the driving current. The embodiments of the present disclosure are not limited thereto.

For example, the refresh frequency of the synchronization signal indicates the frequency of the vertical synchronization signal which is corresponding to respective rows of backlight blocks and which is sent to the backlight control unit. In response to the received vertical synchronization signal, the backlight control unit drives the corresponding backlight blocks to emit light based on parameters, such as the driving current. For example, the refresh frequency of the synchronization signal is a reciprocal of the scanning time period Tn of the sub-pixels of the display blocks corresponding to one row of backlight blocks. For example, the driving current represents a current input to respective backlight blocks to control the LEDs in the backlight block to emit light. For example, in an example, the driving current can be acquired by the following formula (2), and the description is omitted here. For example, the switch channel is used to provide a voltage to the backlight blocks, and the turn-on time period of the switch channel is the scanning time period Tn of the sub-pixels of the display blocks corresponding to one row of backlight blocks. For example, the turn-on time period of the output channel for outputting the driving current is related to local dimming, and can be acquired according to the backlight data which can achieve the local dimming and which is obtained based on related algorithms in the field, description of which is omitted here.

For example, the refresh frequency of the synchronization signal can control the time period of light emission of respective rows of backlight blocks, so that the plurality of rows of backlight blocks emit light in the case where the sub-pixels of the display blocks corresponding to the plurality of rows of backlight blocks are in the display stage, and that the plurality of rows of backlight blocks do not emit light in the case where the sub-pixels of the display blocks corresponding to the plurality of rows of backlight blocks are in the response stage. That is, the time period of light emission of the backlight block avoids the twisting time period (that is, the response stage of the sub-pixel) of the liquid crystal molecules of respective sub-pixels in the display block corresponding to the backlight block, so that each backlight block emits light after the liquid crystal molecules of each sub-pixel in the display block corresponding to the backlight block are twisted (that is, after the display stage of the sub-pixel), and thus the dynamic blurring can be avoided.

Figure 5:
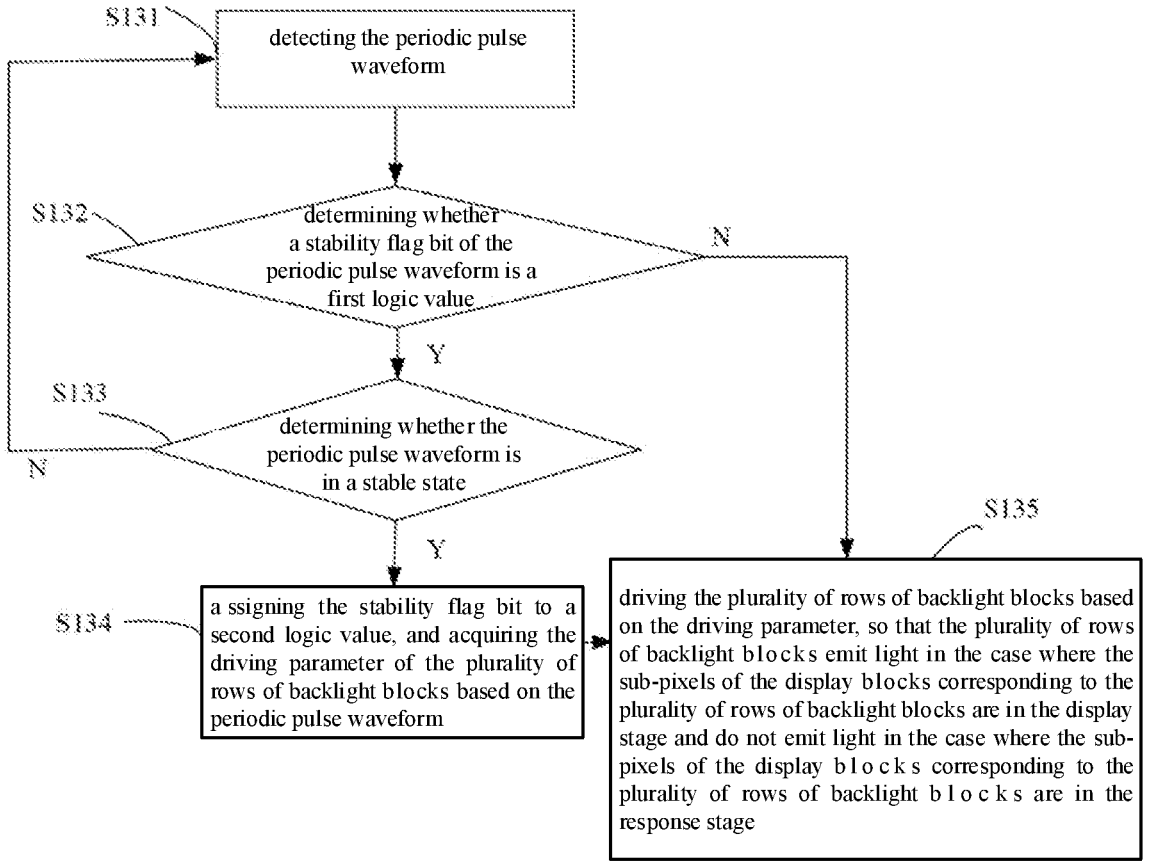
FIG. 5 is a flowchart of an example of driving backlight blocks according to some embodiments of the present disclosure.

FIG. 5 is a flowchart of an example of driving the backlight blocks according to some embodiments of the present disclosure. That is, FIG. 5 is a flowchart of an example of step S130 as shown in FIG. 3. For example, in the example as shown in FIG. 5, the driving method of the backlight blocks includes steps S131 to S135. Hereinafter, the display driving method according to an embodiment of the present disclosure will be described with reference to FIG. 5.

Step S131: detecting the periodic pulse waveform.

For example, it is detected whether the display control unit transmits the periodic pulse waveform PWM generated in, for example, step S121 to the backlight control unit. If the periodic pulse waveform PWM is transmitted to the backlight control unit, the periodic pulse waveform PWM is acquired.

Step S132: determining whether a stability flag bit of the periodic pulse waveform is a first logic value, and if yes, go to step S133; if not, go to step S135.

For example, after the backlight unit is powered on, initialization is firstly performed, and the stability flag bit of the periodic pulse waveform is set to the first logic value (for example, 0). The stability flag bit is used to indicate whether the received periodic pulse waveform is in a stable state. For example, in the case where the received periodic pulse waveform is not in the stable state, the received periodic pulse waveform is set to the first logic value; and in the case where the received periodic pulse waveform is in the stable state, the received periodic pulse waveform is set to the second logic value (for example, 1).

Because the system is not stable enough immediately after the display device is powered on, the situation that a power-on time of the display control unit is later than a power-on time of the backlight unit may occur (at this time, there is no transmission of the periodic pulse waveform), or there may be the situation that the periodic pulse waveform sent by the display control unit is sometimes absent, that is, the periodic pulse waveform does not reach the stable (transmitting) state. Therefore, in order to achieve a better display effect, before driving the backlight blocks, it is necessary to ensure that the acquired periodic pulse waveform is in the stable state, that is, the state that the periodic pulse waveform can be continuously detected.

Step S133: determining whether the periodic pulse waveform is in the stable state. If so, step S134 is performed; if not, step S131 is continued.

For example, the stable state is a state that the periodic pulse waveform is continuously detected and acquired. For example, if the periodic pulse waveform is detected for a plurality of times, if the periodic pulse waveform is detected and acquired for Q consecutive times (Q is an integer greater than 3), the periodic pulse waveform is considered to be in the stable state. If the stable state is not reached, the periodic pulse waveform is continuously detected, and the subsequent step is performed until the stable state is reached.

Step S134: assigning the stability flag bit to the second logic value, and acquiring the driving parameter of the plurality of rows of backlight blocks based on the periodic pulse waveform.

For example, in the case where the periodic pulse waveform is in the stable state, the stability flag bit is assigned the second logical value. At this time, the driving parameter of the plurality of rows of backlight blocks is acquired based on the periodic pulse waveform. For example, the scanning time period Tn of the display blocks corresponding to one row of backlight blocks (that is, the refresh frequency (1/Tn) of the synchronization signal) and the driving current of the plurality of rows of the backlight blocks included in the backlight unit are obtained. At the same time, respective units for driving the backlight unit (for example, the LED driving circuit board 13 as shown in FIG. 1B and the like) are initialized to prepare for the backlight driving in the subsequent steps.

For example, the backlight unit includes N rows and M columns (N and M are integers greater than 1) of backlight blocks, and the display panel includes N rows of display blocks one-to-one corresponding to the N rows of backlight blocks. For example, the following description takes the backlight unit including 4 rows and 4 columns of backlight blocks as an example, that is, N=M=4, but the embodiments of the present disclosure are not limited thereto.

Figure 7:
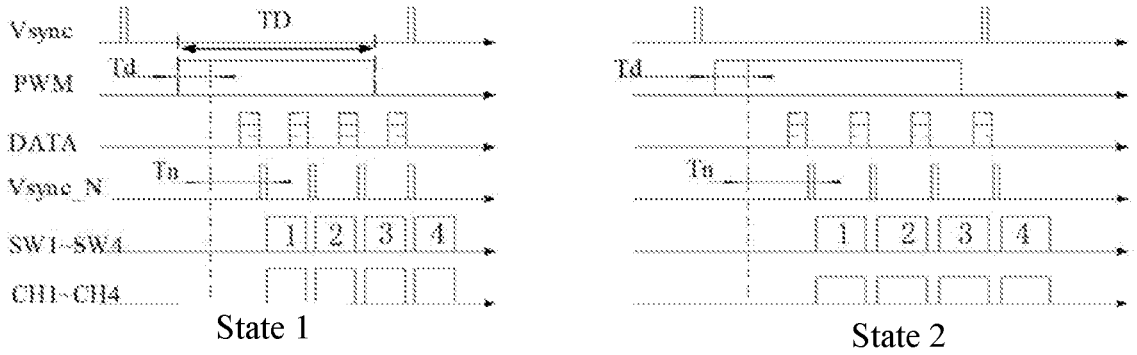
FIG. 7 is a timing diagram of driving the backlight blocks according to some embodiments of the present disclosure.

For example, in some embodiments of the present disclosure, the scanning time period Tn of the sub-pixels of the display blocks corresponding to one row of backlight blocks may be expressed as:

$$Tn=T_D/N \quad (1)$$

where TD is the scanning time period of one frame of display image (i.e., the pulse portion of the periodic pulse waveform as shown in FIG. 7).

Based on the scanning time period Tn of the sub-pixels of the display blocks corresponding to one row of backlight blocks acquired by means of the above formula (1), the following can be obtained: the turn-on time periods of the switch channels for driving respective rows of backlight blocks (widths of SW1 to SW4 as shown in FIG. 7), the refresh frequency, namely 1/Tn, of the vertical synchronization signal Vsync_N which is corresponding to each row of backlight blocks and which is sent to the backlight control unit, and other driving parameters.

Figure 9:
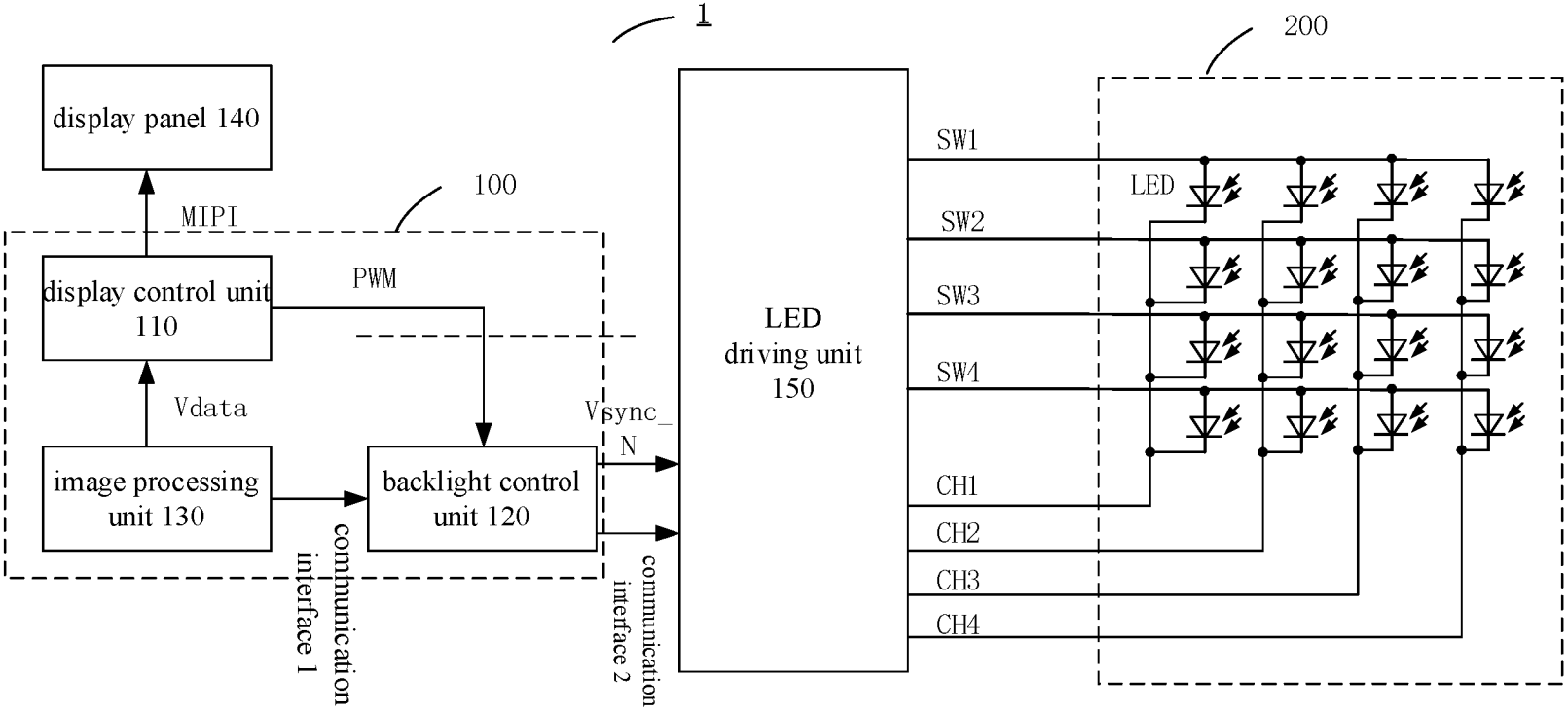
FIG. 9 is a schematic block diagram of a display device according to some embodiments of the present disclosure.

For example, in the case where the backlight unit includes 4 rows and 4 columns of backlight blocks (LED regions arranged in an array) as shown in FIG. 9, for example, as shown in FIG. 7, the driving current of the backlight blocks output by the output channels CH1 to CH4 respectively corresponding to the 4 columns of backlight blocks (i.e., heights corresponding to the output channels CH1 to CH4 as shown in FIG. 7) can be expressed as:

$$In=Ia/f(Tn), \quad (2)$$

where In represents the driving current, Tn represents the scanning time period of the sub-pixels of the display blocks corresponding to one row of backlight blocks, f(Tn) represents a weighting function of Tn, and Ia represents an average current that drives the backlight unit in the case where the display panel reaches a predetermined brightness.

It should be noted that f(Tn) can be a linear function of Tn or a curve function of Tn. For example, the above-mentioned formula (2) can be used to acquire the weighting relationship between the driving current In and the scanning time period Tn of the sub-pixels of the display blocks corresponding to one row of backlight blocks. For example, the average current Ia remains unchanged, and in the case where the scanning time period Tn of the sub-pixels of the display blocks corresponding to one row of backlight blocks becomes larger, the driving current In output by the output channel CH decreases.

For example, the turn-on time period of each of the output channels CH1 to CH4 (that is, the duration for outputting the driving current) is related to the local dimming, and can be acquired according to the backlight data that the image processing unit provides to the backlight unit, which is not repeated here again.

For example, in some embodiments of the present disclosure, based on the scanning parameter (for example, the scanning time period TD) carried in the periodic pulse waveform that the display control unit outputs to the backlight unit, the scanning time period Tn of the display blocks corresponding to each row of backlight blocks and the driving current of the backlight blocks output by the output channels CH1 to CH4 respectively corresponding to respective columns of the backlight blocks may be automatically acquired through the above process, so that manual detection and setting of the above driving parameter can be avoided, and the development efficiency of the display device can be improved.

Step S135: driving the plurality of rows of backlight blocks based on the driving parameter, so that the plurality of rows of backlight blocks emit light in the case where the sub-pixels of the display blocks corresponding to the plurality of rows of backlight blocks are in the display stage and do not emit light in the case where the sub-pixels of the display blocks corresponding to the plurality of rows of backlight blocks are in the response stage.

For example, after driving the plurality of rows of backlight blocks based on the driving parameter acquired in step S134, it may return to step S131 to continue detecting and acquiring the periodic pulse waveform (for example, detecting and acquiring the periodic pulse waveform corresponding to a next frame of display image).

For example, as shown in FIG. 7, after, by taking a rising edge of the periodic pulse waveform (that is, the time at which a first row of display blocks start scanning) as a reference, the response time period Td (for example, the twist time period of the liquid crystal molecules) corresponding to the response stage of one row of sub-pixels and the scanning time period Tn of the sub-pixels of the display blocks corresponding to one row of backlight blocks are delayed, and then the vertical synchronization signal Vsync_1 that controls the first row of backlight blocks is sent. That is, in the case where the first row of backlight blocks are driven, the time period (Td+Tn) is advanced to drive the first row of backlight blocks corresponding to the first row of display blocks of the display panel. For example, the first row of backlight blocks respond to the vertical synchronization signal Vsync_1, and the turn-on time period of the switch channels SW1 to SW4, the turn-on time period of the output channel CH1 of the first row of backlight blocks and the driving current output by the output channel CH1 of the first row of backlight blocks are obtained according to step S134, so as to drive the first row of backlight blocks to emit light. Then, the vertical synchronization signal Vsync_N for driving the backlight blocks is sent every time period Tn, so as to realize the progressive driving of the backlight blocks. For example, the specific implementation process is shown in FIG. 6.

Figure 6:
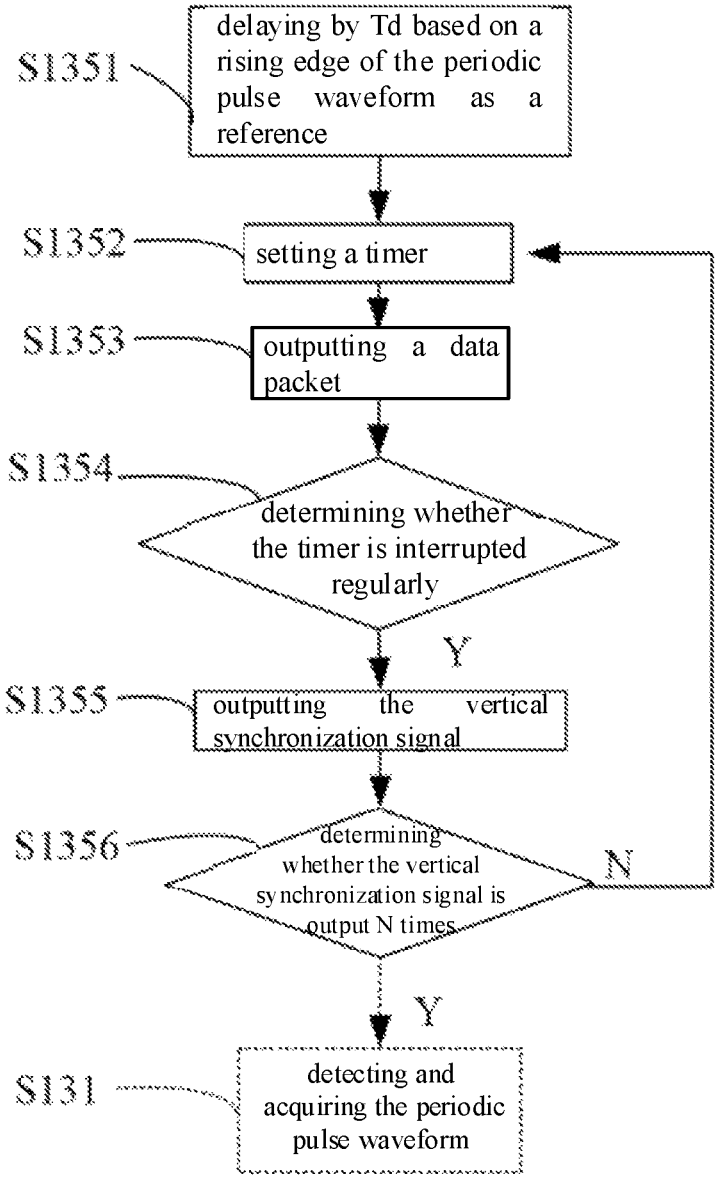
FIG. 6 is a flowchart of an example of driving the backlight blocks row by row in the case where the periodic pulse waveform is in a stable state according to some embodiments of the present disclosure.

FIG. 6 is a flowchart of an example of driving the backlight blocks row by row in the case where the periodic pulse waveform is in the stable state according to some embodiments of the present disclosure. That is, FIG. 6 is a flowchart of an example of step S135 as shown in FIG. 5. For example, in the example as shown in FIG. 6, the driving method of the backlight blocks includes steps S1351 to S1356. Hereinafter, the display driving method according to an embodiment of the present disclosure will be described with reference to FIG. 6.

Step S1351: delaying by Td based on the rising edge of the periodic pulse waveform as a reference.

For example, Td represents the time period corresponding to the response stage of one row of sub-pixels. As shown in FIG. 7, with the sum of the time period Td corresponding to the response stage of one row of sub-pixels and the scanning time period Tn (implemented by a timer of step S1352) of the sub-pixels of the display blocks corresponding to the first row of backlight blocks in advance, the image information is sent to the display panel. That is, the rising edge of the periodic pulse waveform is used as the reference, and the first row of backlight blocks are driven after delaying the time period (Td+Tn), to realize that after the liquid crystal molecules of all the sub-pixels of the display blocks corresponding to the first row of backlight blocks are twisted, the backlight blocks are driven to make the backlight blocks emit light, so that the dynamic blurring phenomenon that occurs during the display process of the display panel can be avoided. For example, in the case of driving the first row of sub-pixels, the response time period Td corresponding to the response stage of one row of sub-pixels is delayed on the basis of delaying the scanning time period Tn, which can avoid that a last row of sub-pixels are still in the response stage of the liquid crystal in the case where the first row of backlight blocks emit light, and thus can further avoid the dynamic blurring phenomenon that occurs during the display process of the display panel.

It should be noted that the time period Td corresponding to the response stage (that is, the twist time period of the liquid crystal molecules of the one row of sub-pixels) of the one row of sub-pixels can be set according to experience in the field or be acquired through prior detection and experiment. For example, Td=4 ms, the embodiments of the present disclosure are not limited to this case.

Step S1352: setting the timer.

For example, the timer is used to control the frequency of sending the vertical synchronization signal that controls the respective rows of backlight blocks. As shown in FIG. 7, a timer having a time period equal to the scanning time period Tn of the sub-pixels of the display blocks corresponding to one row of backlight blocks can be set, that is, the vertical synchronization signal Vsync_N is output to the LED driving unit as shown in FIG. 9 every time period Tn, Therefore, the LED driving unit can control the turn-on time period of the switch channels SW of the backlight blocks in the corresponding row or the turn-on time period of the output channels CH and the driving current output by the output channels CH in response to the vertical synchronization signal to control the display of the LEDs in the backlight blocks in the corresponding row.

Step S1353: outputting a data packet.

For example, after the timer is started, the data packet DATA carrying the driving parameter (for example, including the turn-on time period of the output channels CH and the driving current output by the output channels CH, the turn-on time period of the switch channels SW, etc.) may be sent to the backlight blocks, so that in the subsequent steps, in the case where the vertical synchronization signal Vsync_N corresponding to each row of backlight blocks is received, the LEDs in each row of backlight blocks are driven to emit light based on the driving parameter included in the data packet.

Step S1354: determining whether the timer is interrupted regularly. If yes, execute step S1355; if not, continue to determine whether the timer is interrupted.

For example, the timer is interrupted, that is, the sub-pixels in the display blocks corresponding to the one row of backlight blocks finish the scanning Correspondingly, data signals are written into these sub-pixels, and the liquid crystal molecules of these sub-pixels are already twisted to an angle corresponding to a gray to be displayed, and at this time, the backlight blocks can emit light to achieve the corresponding display. By setting the timer, the transmission of the vertical synchronization signal corresponding to respective rows of backlight blocks can be automatically controlled.

Step S1355: outputting the vertical synchronization signal.

For example, starting from the vertical synchronization signal Vsync_1 of the first row of backlight blocks, the following vertical synchronization signal are outputted in sequence at an interval timed by the timer: a vertical synchronization signal Vsync_2 of a second row of backlight blocks, a vertical synchronization signal Vsync_3 of a third row of backlight blocks, and a vertical synchronization signal Vsync_4 of a fourth row of backlight blocks (when four rows of backlight blocks are included, that is, N=4). After the LED driving unit receives the vertical synchronization signal corresponding to a certain row of backlight blocks, the LED driving unit controls the LEDs in the row of backlight blocks to emit light based on the driving parameter in the data packet DATA in the row.

In the process that the first row of backlight blocks emit light so that the display blocks corresponding to the first row of backlight blocks perform display, the display panel performs a scanning operation on the display blocks corresponding to the second row of backlight blocks to write data signals into these sub-pixels of the display blocks corresponding to the second row of backlight blocks.

Step S1356: determining whether the vertical synchronization signal is output N times. If so, execute step S131 as shown in FIG. 5; if not, continue to execute step S1352 until the LEDs of all the backlight blocks are lit.

For example, because the backlight unit includes N rows of backlight blocks, the display of one frame is completed only after the LEDs of the N rows of backlight blocks are lit. Therefore, after the vertical synchronization signal is output N times, that is, after the display of the frame of display image is completed, the process may return to step S131 to continue detecting and acquiring the periodic pulse waveform corresponding to a next frame of display image.

For example, in the case where the vertical synchronization signal of a next row of backlight blocks arrives, that is, in the case where the light-emitting elements (for example, LEDs) of the next row of backlight blocks are in a light-emitting state, the LEDs of a previous row of backlight blocks are in a non-light-emitting state.

In another embodiment, in step S1356, if not, continue to perform step S1354 until the LEDs of all backlight blocks are lit.

FIG. 7 is a timing diagram of driving the backlight blocks provided by some embodiments of the present disclosure. For example, as shown in FIG. 7, state 1 and state 2 are schematic diagrams of the frequency of the synchronization signal VSYNC_N, the turn-on time period of the switch channels SW and the driving current transmitted by the output channels CH which are sent to the LED driving unit in the case where the display control unit outputs the periodic pulse waveform PWM with different duty cycles (that is, the refresh frequencies or scanning time period of the same display panel is different).

As shown in FIG. 7, the pulse width (i.e., the scanning time period TD) of the periodic pulse waveform in state 2 is greater than the pulse width of the periodic pulse waveform in state 1, which can be known from formula (1). Therefore, in state 2, the scanning time period Tn of the sub-pixels of the display blocks corresponding to one row of backlight blocks becomes larger. Because the switch channels SW are turned on for the same time as the scanning time period Tn of the sub-pixels of the display blocks corresponding to one row of backlight blocks, the switch channels SW are turned on in state 2 for a time period longer than the time period that the switch channels SW are turned on in the state 1.

In the case where the scanning time period TD or the scanning frequency of the display panel changes, in order to ensure that the brightness of the entire display panel is maintained in a stable state (for example, at a predetermined brightness), the brightness of the LEDs in each backlight block in the direct-lit backlight unit is required to be unchanged in any case. That is, the average current Ia for driving the LEDs in the backlight unit to emit light remains unchanged. Based on formula (2), in order to keep the average current Ia for driving the LEDs in the backlight unit to emit light remains unchanged, in the case where the scanning time period Tn of the sub-pixels of the display blocks corresponding to one row of backlight blocks becomes larger, the driving current In output by the output channels CH needs to be reduced. Therefore, in the state 2, an amplitude of the driving current In provided by the output channels CH1 to CH4 is lower than an amplitude of the driving current In provided by the output channels CH1 to CH4 in the state 1. For example, under the premise of ensuring that the brightness of the display panel is maintained at the predetermined brightness, that is, the amplitude of the driving current correspondingly output by the output channels CH1 to CH4 and the turn-on time period of the switch channels SW remain unchanged in a certain state, then local dimming is performed on each backlight block based on the backlight data. For example, in the case where the local dimming is performed on the LEDs of each backlight block based on the backlight data that the image processing unit sends to the backlight control unit, the turn-on time period of the output channels CH1~CH4, namely the time period that the output channels CH1~CH4 output the driving current (that is, the width of the output channels CH1 to CH4 in FIG. 7), can be adjusted through the backlight data, to achieve local dimming.

It should be noted that, the flowchart of the display driving method provided by some embodiments of the present disclosure may include more or less operations, and the operations may be performed sequentially or in parallel. Although the flowchart of the display driving method described above includes a plurality of operations occurring in a specific order, it should be clearly understood that, the order of the plurality of operations is not limited. The display driving method described above may be performed once or may be performed a plurality of times according to predetermined conditions.

The display driving method provided by the above embodiments of the present disclosure can avoid the dynamic blurring phenomenon that occurs during the display process of the display panel, optimize the display effect of the display panel, ensure the display brightness of the display panel, and improve the user experience; at the same time, in the case where the refresh frequency and the liquid crystal scanning time period of the liquid crystal display panel are changed, the scanning time period and driving parameter of the backlight unit are automatically detected and set, which reduces labor costs and improves the development efficiency of the display device.

Figure 8:
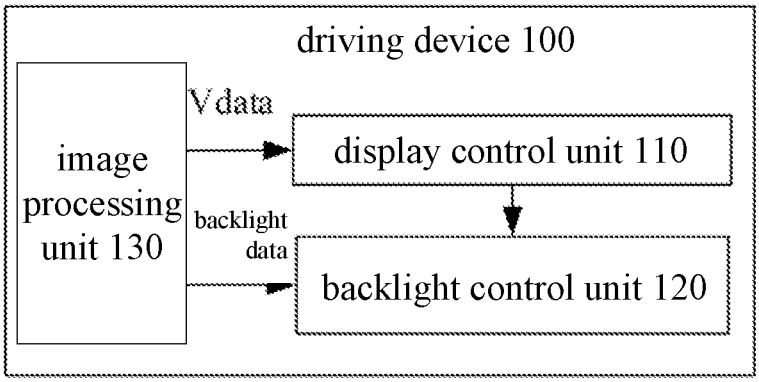
FIG. 8 is a schematic block diagram of a driving device according to some embodiments of the present disclosure.

FIG. 8 is a schematic block diagram of the driving device of the display device provided by some embodiments of the present disclosure. For example, in an example, the driving device 100 of the display device includes the display control unit 110 and the backlight control unit 120. For example, these units may be implemented in the form of hardware (for example, a circuit), firmware, or software, and any combination thereof. For example, these units may be implemented as integrated circuit chips. For example, the display control unit 110 and the backlight control unit 120 may be integrated into the same integrated circuit chip.

The display control unit 110 is configured to send the image information of the display image to the display panel, acquire the scanning parameter of the display image from the image information, and send the scanning parameter to the backlight control unit 120. For example, the display control unit 110 may implement steps S110 and S120. For specific implementation methods, reference may be made to related descriptions of steps S110 and S120, and details are not described herein again.

The backlight control unit 120 is configured to acquire the driving parameter of the plurality of rows of backlight blocks of the backlight unit based on the scanning parameter of the display image, and drive the plurality of rows of backlight blocks based on the driving parameter. For example, in another example, the backlight control unit is further configured to drive the plurality of rows of backlight blocks based on driving parameter, so that the plurality of rows of backlight blocks emit light in the case where the sub-pixels of the display blocks corresponding to the plurality of rows of backlight blocks are in the display stage, and do not emit light in the case where the sub-pixels of the display blocks corresponding to the plurality of rows of backlight blocks are in the response stage. For example, the backlight control unit 120 may implement step S130. For a specific implementation method, refer to the related description of step S130, and details are not described herein again. For example, the backlight control unit 120 may be specifically implemented as the MCU 131 as shown in FIG. 1B, the embodiments of the present disclosure are not limited to this case.

For example, in another example, the driving device 100 of the display device further includes the image processing unit 130.

For example, the image processing unit 130 is configured to send the image information of the display image and the backlight data of the backlight unit to the display control unit 110 and the backlight control unit 120, respectively.

For example, in another example, the display control unit 110 is further configured to generate the periodic pulse waveform synchronized with the scanning time period and the blanking time period of the display image based on the image information of the display image and to send the periodic pulse waveform for control of the backlight unit.

For example, the backlight control unit 130 is further configured to: detect and acquire the periodic pulse waveform; determine the logical value of the stability flag bit of the periodic pulse waveform; if the stability flag bit of the periodic pulse waveform is the first logical value, determine whether the periodic pulse waveform is in the stable state; if the stability flag bit of the periodic waveform is the second logic value, drive the plurality of rows of backlight blocks based on the driving parameter, so that the plurality of rows of backlight blocks emit light in the case where the sub-pixels of the display blocks corresponding to the plurality of rows of backlight blocks are in the display stage and do not emit light in the case where the sub-pixels of the display blocks corresponding to the plurality of rows of backlight blocks are in the response stage.

For example, the backlight control unit 120 is further configured to: in the case where the periodic pulse waveform is in the stable state, assign the stability flag bit to the second logic value, and acquire the driving parameter of the plurality of rows of backlight blocks based on the periodic pulse waveform; in the case where the periodic pulse waveform is not in the stable state, continue to detect and acquire the periodic pulse waveform.

For example, the backlight control unit 120 is further configured to: after, by taking the rising edge of the periodic pulse waveform as a reference, delaying the time period corresponding to the response stage of one row of sub-pixels and the scanning time period of the sub-pixels of the display blocks corresponding to one row of backlight blocks, and then drive the plurality of rows of backlight blocks row by row based on the driving parameter.

For example, the backlight control unit 120 is further configured to: after the first row of backlight blocks are driven, drive the plurality of rows of backlight blocks, other than the first row of backlight blocks, row by row with an interval which is equal to the scanning time period of the sub-pixels of the display blocks corresponding to the row of backlight blocks.

For example, the backlight control unit 120 is further configured to enable the light-emitting element in the previous row of backlight blocks in a non-light-emitting state in the case where the vertical synchronization signal of the next row of backlight blocks arrives.

It should be noted that, the driving device of the display device provided by the embodiments of the present disclosure may include more or fewer circuits or units, and the connection relationship among the respective circuits or units is not limited and may be determined according to actual needs. The specific configuration of each circuit is not limited, and may include an analog device according to the circuit principle, or may also include digital chips, or other suitable manners.

For the technical effects of the driving device 100 of the display device provided by some embodiments of the present disclosure, reference may be made to the technical effects of the display driving method provided by the embodiments of the present disclosure, and details are not described herein again.

At least one embodiment of the present disclosure also provides the display device, and the display device includes the display panel, the backlight unit, and the driving device of the display device provided by any one embodiment of the present disclosure. FIG. 9 is a schematic block diagram of the display device provided by some embodiments of the present disclosure. As shown in FIG. 9, the display device 1 includes the display panel 140, the backlight unit 200, and the driving device 100 of the display device provided by any one of the embodiments of the present disclosure.

For example, the backlight unit 200 includes the plurality of backlight blocks. For example, only the backlight unit 200 including four rows and four columns of backlight blocks is shown in FIG. 9. As shown in FIG. 9, each backlight block includes only one LED, however, the embodiments of the present disclosure are not limited thereto. For example, the backlight unit 200 is driven by using the local dimming method.

For example, the display device 1 may further include the LED driving unit 150 and the switch channels SW1 to SW4 (which, for example, provide a voltage) connected to the LEDs in the plurality of rows of backlight blocks and include the output channels CH1 to CH4 for providing the driving current to the LEDs in the plurality of rows of backlight blocks. For example, the driving currents output by the switch channels SW1 to SW4 and the output channels CH1 to CH4 can be acquired by the display driving algorithm provided by some embodiments of the present disclosure, and the turn-on time period of the output channels CH1 to CH4 can be acquired according to the backlight data to achieve local dimming. For example, the driving device 100 includes the display control unit 110, the backlight control unit 120 and the image processing unit 130. For example, the image processing unit 130 sends the image information Vdata of the display image to the display control unit 110, and sends the backlight data (for example, the backlight local control signal as shown in FIG. 1B) to the backlight control unit 120 (which is, for example, implemented as MCU 131 as shown in FIG. 1B) via a communication interface 1. The image processing unit 130 may be implemented by hardware, firmware, software, or any combination thereof. For example, the image processing unit 130 may be implemented as an integrated circuit chip. For example, the image processing unit 130 may be implemented as the FPGA/SOC/TCON 12 shown in FIG. 1B.

For example, the display control unit 110 may acquire the image information after performing image rendering in the image processing unit 130 through a physical interface, such as HDMI (High Definition Multimedia Interface), convert the image information into, for example, the MIPI (Mobile Industry Processor Interface) signal as shown in FIG. 4 via the bridge chip, and transmit the MIPI signal to the display panel under the control of the vertical synchronization signal Vsync, so as to control the liquid crystal molecules in the display panel to perform corresponding twisting. At the same time, the display control unit 110 generates the periodic pulse waveform PWM synchronized with the scanning time period TD and the blanking time period TS of the MIPI signal according to the MIPI signal, and sends the periodic pulse waveform PWM to the backlight control unit 120, so that the backlight control unit 120 can automatically acquire the driving parameter of the backlight unit by detecting the periodic pulse waveform PWM and based on the scanning parameter (such as the scanning time period TD) carried by the periodic pulse waveform PWM.

For example, the backlight control unit 120 transmits the driving parameter (for example, the turn-on time period of the switch channels SW, the driving current output by the output channels CH1 to CH4) generated according to the periodic pulse signal PWM received from the display control unit 110, and the vertical synchronization signal Vsync_N and the parameters, such as the turn-on time period of the output channels CH1 to CH4, acquired according to the backlight data in the backlight control unit 120 (for example, these parameters may be parameters included in the brightness control signal as shown in FIG. 1B) to the LED driving unit 150 (which is, for example, equivalent to the LED integrated circuit driving chip 132 as shown in FIG. 1B) through the communication interface 2, so as to drive the LEDs in the backlight blocks to emit light based on the driving parameter and the backlight data under the control of the vertical synchronization signal Vsync_N. For example, the communication interface 1 and the communication interface 2 may adopt wired transmission or wireless transmission, the embodiments of the present disclosure are not limited in this aspect.

For example, the display device 100 may be a thin film transistor liquid crystal display device, an electronic paper display device, or the like. For example, the display device is a VR device, such as a VR helmet or the like, and the embodiments of the present disclosure are not limited thereto.

For example, these components are interconnected by a bus system and/or other coupling mechanisms (not shown in figures). For example, the bus system may be a serial, parallel communication bus, etc., and the embodiments of the present disclosure are not limit thereto. It should be noted that the components and structures of the display device 1 as shown in FIG. 9 are merely exemplary and not limitative, and the display device 1 may include other components and structures as needed.

Technical effects of the display device 1 provided by some embodiments of the present disclosure can be referred to the corresponding descriptions of the display driving method in the above embodiments, and details are not described herein again.

The following should be noted:

1) Only the structures involved in the embodiments of the present disclosure are illustrated in the drawings of the embodiments of the present disclosure, and other structures can refer to usual designs.

(2) The embodiments and features in the embodiments of the present disclosure may be combined in case of no conflict to acquire new embodiments.

What have been described above merely are exemplary embodiments of the disclosure, and not intended to define the scope of the disclosure, and the scope of the disclosure is determined by the appended claims.

What is claimed is:

1. A display driving method of a display device, wherein the display device comprises a display panel and a backlight unit, the display panel comprises a plurality of rows of display blocks, the backlight unit comprises a plurality of rows of backlight blocks, and the plurality of rows of backlight blocks are configured to provide light for display to the plurality of rows of display blocks of the display panel respectively and correspondingly, and the display driving method comprises:

sending image information of a display image to the display panel;

acquiring a scanning parameter of the display image from the image information; and acquiring a driving parameter of the plurality of rows of backlight blocks based on the scanning parameter of the display image, and driving the plurality of rows of backlight blocks based on the driving parameter, wherein acquiring the scanning parameter of the display image from the image information, comprises:

generating a periodic pulse waveform that is synchronized with a scanning time period and a blanking time period of the display image based on the image information of the display image; and sending the periodic pulse waveform to control the backlight unit;

wherein acquiring the driving parameter of the plurality of rows of backlight blocks based on the scanning parameter of the display image, and driving the plurality of rows of backlight blocks based on the driving parameter, comprises:

detecting and acquiring the periodic pulse waveform; and determining a logic value of a stability flag bit of the periodic pulse waveform;

if the stability flag bit of the periodic pulse waveform is a first logic value, determining whether the periodic pulse waveform is in a stable state; and if the stability flag bit of the periodic waveform is a second logic value, driving the plurality of rows of backlight blocks based on the driving parameter, so that the plurality of rows of backlight blocks respectively emit light in a case where the sub-pixels of the display blocks corresponding to the plurality of rows of backlight blocks are in a display stage, and do not emit light in a case where the sub-pixels of the display blocks corresponding to the plurality of rows of backlight blocks are in a response stage.

2. The display driving method according to claim 1, wherein each display block comprises a plurality of rows of sub-pixels, a display operation of the plurality of rows of sub-pixels comprises the response stage and the display stage after the response stage, and driving the plurality of rows of backlight blocks based on the driving parameter, comprises:

enabling the plurality of rows of backlight blocks to respectively emit light in a case where the sub-pixels of the display blocks corresponding to the plurality of rows of backlight blocks are in the display stage, and enabling the plurality of rows of backlight blocks not to emit light in a case where the sub-pixels of the display blocks corresponding to the plurality of rows of backlight blocks are in the response stage.

3. The display driving method according to claim 1, wherein if the stability flag bit of the periodic pulse waveform is the first logic value, determining whether the periodic pulse waveform is in the stable state, comprises:

in a case where the periodic pulse waveform is in the stable state, assigning the stability flag bit to the second logic value, and acquiring the driving parameter of the plurality of rows of backlight blocks based on the periodic pulse waveform; and in a case where the periodic pulse waveform is not in the stable state, continuing to detect and acquire the periodic pulse waveform.

4. The display driving method according to claim 1, wherein if the stability flag bit of the periodic pulse waveform is the second logic value, driving the plurality of rows of backlight blocks based on the driving parameter, comprises:

after, by taking a rising edge of the periodic pulse waveform as a reference, delaying a time period corresponding to the response stage of one row of sub-pixels and a scanning time period of the sub-pixels of the display blocks corresponding to one row of backlight blocks, driving the plurality of rows of backlight blocks row by row based on the driving parameter.

5. The display driving method according to claim 4, wherein after driving a first row of backlight blocks, the plurality of rows of backlight blocks, other than the first row of backlight blocks, are driven row by row with an interval which is equal to the scanning time period of the sub-pixels of the display blocks corresponding to the one row of backlight blocks.

6. The display driving method according to claim 1, wherein the stable state is a state that the periodic pulse waveform is continuously detected.

7. The display driving method according to claim 1, wherein the driving parameter comprises a refresh frequency and a driving current of a synchronization signal.

8. The display driving method according to claim 7, wherein the refresh frequency of the synchronization signal is a reciprocal of a scanning time period of the sub-pixels of the display blocks corresponding to one row of backlight blocks.

9. The display driving method according to claim 7, wherein the driving current is expressed as:

$$In=Ia/f(Tn),$$

where In represents the driving current, Tn represents the scanning time period of the sub-pixels of the display blocks corresponding to the one row of backlight blocks, f(Tn) represents a weighting function of Tn, and Ia represents an average current that drives the backlight unit in a case where the display panel reaches a predetermined brightness.

10. The display driving method according to claim 1, wherein the backlight unit is driven by a local dimming manner.

11. The display driving method according to claim 1, wherein in a case where a vertical synchronization signal of a next row of backlight blocks arrives, light-emitting elements in a previous row of the backlight blocks are in a non-light-emitting state.

12. A driving device of a display device, wherein the display device comprises a display panel and a backlight unit, the display panel comprises a plurality of rows of display blocks, the backlight unit comprises a plurality of rows of backlight blocks, the plurality of rows of backlight blocks are configured to provide light for display to the plurality of rows of display blocks of the display panel respectively and correspondingly, and the driving device comprises a display control unit and a backlight control unit, wherein the display control unit is configured to send image information of a display image to the display panel, and acquire a scanning parameter of the display image from the image information and send the scanning parameter to the backlight control unit; and the backlight control unit is configured to acquire a driving parameter of the plurality of rows of backlight blocks of the backlight unit based on the scanning parameter of the display image, and drive the plurality of rows of backlight blocks based on the driving parameter, wherein the display control unit is further configured to generate a periodic pulse waveform that is synchronized with a scanning time period and a blanking time period of the display image based on the image information of the display image, and to send the periodic pulse waveform to control the backlight unit, wherein the backlight control unit is further configured to:

detect and acquire the periodic pulse waveform; and determine a logic value of a stability flag bit of the periodic pulse waveform;

if the stability flag bit of the periodic pulse waveform is a first logic value, determine whether the periodic pulse waveform is in a stable state; and if the stability flag bit of the periodic waveform is a second logic value, drive the plurality of rows of backlight blocks based on the driving parameter, so that the plurality of rows of backlight blocks respectively emit light in a case where the sub-pixels of the display blocks corresponding to the plurality of rows of backlight blocks are in a display stage, and do not emit light in a case where the sub-pixels of the display blocks corresponding to the plurality of rows of backlight blocks are in a response stage.

13. The driving device according to claim 12, further comprising an image processing unit, wherein the image processing unit is configured to send the image information of the display image and backlight data of the backlight unit to the display control unit and the backlight control unit, respectively.

14. The driving device according to claim 12, wherein each display block comprises a plurality of rows of sub-pixels, a display operation of the plurality of rows of sub-pixels comprises a response stage and a display stage after the response stage, and the backlight control unit is further configured to control the plurality of rows of backlight blocks to respectively emit light in a case where the sub-pixels of the display blocks corresponding to the plurality of rows of backlight blocks are in the display stage, and to control the plurality of rows of backlight blocks not to emit light in a case where the sub-pixels of the display blocks corresponding to the plurality of rows of backlight blocks are in the response stage.

15. The driving device according to claim 12, wherein the backlight control unit is further configured to:

in a case where the periodic pulse waveform is in the stable state, assign the stability flag bit to the second logic value, and acquire the driving parameter of the plurality of rows of backlight blocks based on the periodic pulse waveform; and in a case where the periodic pulse waveform is not in the stable state, continue to detect and to acquire the periodic pulse waveform.

16. A display device, comprising a driving device, a display panel, and a backlight unit, wherein the display panel comprises a plurality of rows of display blocks, the backlight unit comprises a plurality of rows of backlight blocks, the plurality of rows of backlight blocks are configured to provide light for display to the plurality of rows of display blocks of the display panel respectively and correspondingly, and the driving device comprises a display control unit and a backlight control unit, wherein the display control unit is configured to send image information of a display image to the display panel, and acquire a scanning parameter of the display image from the image information and send the scanning parameter to the backlight control unit; and the backlight control unit is configured to acquire a driving parameter of the plurality of rows of backlight blocks of the backlight unit based on the scanning parameter of the display image, and drive the plurality of rows of backlight blocks based on the driving parameter, wherein the display control unit is further configured to generate a periodic pulse waveform that is synchronized with a scanning time period and a blanking time period of the display image based on the image information of the display image, and to send the periodic pulse waveform to control the backlight unit;

wherein the backlight control unit is further configured to:

detect and acquire the periodic pulse waveform; and determine a logic value of a stability flag bit of the periodic pulse waveform;

if the stability flag bit of the periodic pulse waveform is a first logic value, determine whether the periodic pulse waveform is in a stable state; and if the stability flag bit of the periodic waveform is a second logic value, drive the plurality of rows of backlight blocks based on the driving parameter, so that the plurality of rows of backlight blocks respectively emit light in a case where the sub-pixels of the display blocks corresponding to the plurality of rows of backlight blocks are in a display stage, and do not emit light in a case where the sub-pixels of the display blocks corresponding to the plurality of rows of backlight blocks are in a response stage;

wherein the backlight unit is driven by a local dimming manner, and is configured to provide light for display to the display panel.

* * * * *